United States Patent [19]

Chevalier

[11] Patent Number: 4,735,612

[45] Date of Patent: Apr. 5, 1988

[54] TRAUMA MINIMIZING DART

[75] Inventor: Martin A. Chevalier, Hudson, Wis.

[73] Assignee: BallistiVet, Inc., White Bear Lake, Minn.

[21] Appl. No.: 903,259

[22] Filed: Sep. 3, 1986

[51] Int. Cl.[4] ..... A61M 5/20

[52] U.S. Cl. ..... 604/130; 604/272; 102/512; 273/418

[58] Field of Search ..... 604/117, 130, 174, 239–241, 604/272–274; 102/502, 512; 273/418

[56] References Cited

U.S. PATENT DOCUMENTS

| | | | |
|---|---|---|---|
| 2,348,337 | 5/1944 | Francis | 604/130 X |
| 2,512,568 | 6/1950 | Saffir | 604/272 X |
| 2,854,925 | 10/1958 | Crockford et al. | 604/130 X |
| 3,022,785 | 2/1962 | Crockford et al. | 604/130 X |
| 3,207,157 | 9/1965 | Murdoch | 604/130 |
| 3,209,695 | 10/1965 | Crockford et al. | 102/92 |
| 3,209,696 | 10/1965 | Palmer et al. | 102/92 |
| 3,386,381 | 6/1968 | Ferb | 102/512 |
| 3,715,990 | 2/1973 | Palmer | 102/92 |
| 4,103,893 | 8/1978 | Walker | 273/106 |
| 4,383,530 | 5/1983 | Bruno | 604/274 |

*Primary Examiner*—Dalton L. Truluck

*Attorney, Agent, or Firm*—Merchant, Gould, Smith, Edell, Welter & Schmidt

[57] ABSTRACT

The invention is directed toward an injecting dart having improved vent and barb designs and reduced weight. The dart (10, 10') preferably includes a needle (12, 12') and a body having a forward section (14, 14') and a tail section (16, 16'). The needle (12, 12') forms an integral barb (24, 24'). In one embodiment (10), the tail section (16) includes several fins (17) with vent holes (38) between adjacent pairs of fins (17). In another embodiment (10') vents are formed by slots (52'), threads (54') and flats (56') on the threads (54'). The integral barb (24, 24') eliminates barb/needle bonding problems. The multiple vent holes (38, 52') permit free movement of the dart's piston, thereby ensuring complete and sufficiently rapid delivery of the liquid to the animal. In one embodiment, (10') the needle (12') is integral with the forward section (14') so as to increase the reliability and reduce the weight of the dart (10'). The fins (17') of dart (10') are preferably relieved, also to reduce weight.

21 Claims, 3 Drawing Sheets

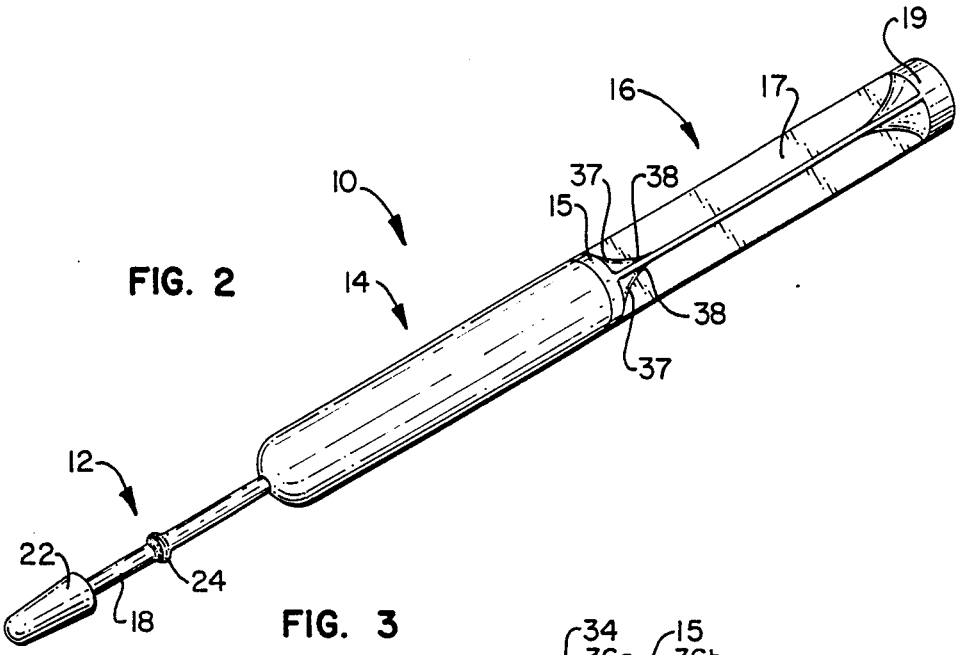
FIG. 2
FIG. 3
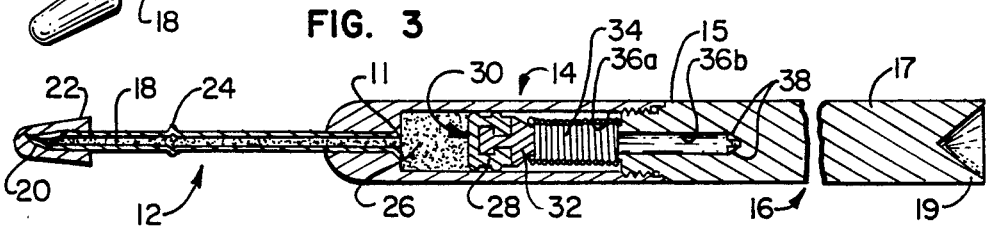
FIG. 4
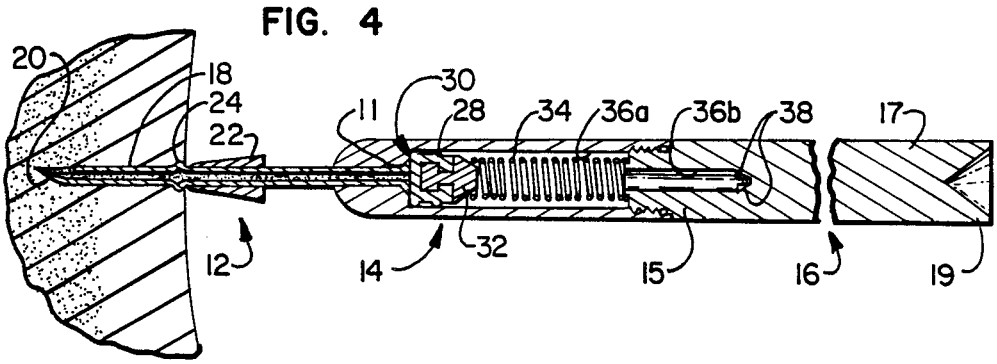

TRAUMA MINIMIZING DART

FIELD OF THE INVENTION

This invention generally relates to projectiles for the injection of a liquid into an animal located at a distance, and more particularly to an injecting dart which is constructed to minimize tissue trauma.

BACKGROUND OF THE INVENTION

Various types of projectiles which can be fired at an animal from a distance and which on impact inject a liquid through a needle into the animal have been proposed. The liquid, e.g., liquid tranquilizer, is typically stored in a cylindrical "primary chamber" within the projectile. One side of a movable piston or the like is typically in contact with the liquid within the primary chamber. The opposite side of the piston faces a "secondary chamber" which includes means for driving the piston toward the primary chamber. Movement of the piston toward the primary chamber pressurizes the liquid and causes it to flow through the needle into the animal.

Unfortunately, most prior art hypodermic projectiles cause considerable damage to animals. They damage outer tissue, including hide, upon impact; then they damage inner tissue layers when they violently dispense their liquid contents.

Several characteristics of prior art hypodermic projectiles contribute to their tendency to cause tissue damage. For example, many existing injecting or hypodermic projectiles include relatively aggressive triggering mechanisms for releasing the liquid from the primary chamber after the projectile strikes its target. For example, some projectiles include a chemical charge in the secondary chamber which explodes upon impact to drive the piston toward the primary chamber. Reference is made to U.S. Pat. No. 3,209,695, issued to Crockford et al. As another example, some projectiles include pressurized secondary chambers, wherein the secondary chamber is pressurized prior to firing of the dart or as a result thereof. See, e.g., U.S. Pat. Nos. 4,103,893, issued to Walker and 3,209,696, issued to Palmer et al. When the needle strikes and penetrates the animal, the primary chamber is placed in fluid communication with the hollow needle and the pressurized secondary chamber causes the piston to rapidly push the liquid through the needle and into the animal.

Experience has shown that there are problems associated with a pressurized secondary chamber, whether the pressure is due to chemical explosion or a compressed gas. For example, it is very difficult to guarantee that the secondary chamber will be properly pressurized in all cases. If the secondary chamber is insufficiently pressurized, the piston separating the primary and secondary chambers will be unable to force the entire contents of the primary chamber through the needle. On the other hand, if the secondary chamber is overly pressurized, the liquid in the primary chamber will rapidly spurt through the needle. This can damage the animal's tissue. In fact, "gas-propelled" pistons can inject liquid into an animal at such an explosive rate that the liquid literally bores a hole in the animal's tissue. The volume of liquid injected (approximately 2 to 4 cc) is large enough to cause considerable trauma to the animal's tissue. Tissue trauma can also be caused simply by the impact of a dart; this problem is discussed below.

In addition to the secondary chamber problem discussed above, it is perceived that prior art injecting projectiles have inadequate barbs. A barb is defined herein as any type of lateral protrusion on the penetrating needle which helps retain the needle within the animal during the liquid injection process.

Barbs are typically prefabricated and attached to dart needles in separate assembly operations. U.S. Pat. Nos. 3,209,695 and 3,209,696 show darts having such prefabricated barbs. While the use of prefabricated barbs can be cost effective, it is perceived that this technique can create problems. For example, the bond between the barb and the needle might fail, in which case the barb will not help retain the needle within the animal. If the tip of the needle does not remain in the animal's muscle for a sufficiently long period of time, some of the liquid could be deposited within the fatty subcutaneous layer immediately beneath the animal's hide or otherwise wasted. And, if the barb should become disconnected from the needle when the needle and barb are in the animal, the barb could remain in the animal when the needle is withdrawn, potentially harming the animal.

Also, a prefabricated barb could be improperly attached to its needle. For example, a prefabricated barb could be attached backwards, such that its biting edge or lip is toward the tip of the needle. A backwards barb could obviously cause unnecessary damage to an animal. In addition, a backwards barb would not assist in retaining the needle in an animal during the injection process.

Aside from the problems associated with bonding the barb to the needle, some barbs are overly "aggressive." An overly aggressive barb can be defined as one which extends laterally from the needle to an excessive extent or which is shaped to hook an animal's hide, making removal difficult. If a barb is too aggressive, it will retain the needle within the animal for an unnecessarily long period of time. The needle need only be within the animal for a period of time sufficient to allow transfer of the contents of the primary chamber into the animal.

In addition, most prior art hypodermic projectiles are so complex as to be too heavy for accurate long range injections and excessively costly. The weight of prior art hypodermic projectiles is particularly troublesome. Prior art projectiles often include aluminum or steel components. Unfortunately, the heavier the dart, the greater the trauma to the animal occasioned simply by the momentum of the dart. Animals which are inoculated, for example, with prior art projectiles almost invariably suffer a hematoma at the dart's entry point.

Thus, while prior art hypodermic projectiles are generally useful for their intended purposes, as a class they possess several shortcomings. In summary, they often include complicated trauma-producing triggering mechanisms, disadvantageous barbs and heavy components which can cause impact damage to the animal.

A projectile which addresses most of the problems discussed above is shown in FIG. 1. This projectile, developed by G. L. van Rooyen, includes a simple compression spring in its secondary chamber and does not rely on a pressurized secondary chamber. In fact, a small hole 46 vents the secondary chamber to the atmosphere The single small vent hole 46 allows the spring to freely compress as the primary chamber is loaded and permits the piston to controllably and fully discharge the contents of the primary chamber upon impact of the dart.

Further with regard to the basic van Rooyen dart shown in FIG. 1, the liquid is initially loaded into the primary chamber through the needle. As the primary chamber fills, the piston moves toward the secondary chamber and the spring compresses. Once the primary chamber is filled, the tip of the needle is capped. Alternatively, the piston is placed in a preselected position so as to establish, for example, a 2 cc primary chamber volume; the primary chamber is filled; the needle is capped; and a compressed spring is positioned behind the piston within the secondary chamber to pressurize the primary chamber. In either event, when the projectile strikes an animal, the needle penetrates the resilient cap and the animal's hide, and the pressurized liquid in the primary chamber flows through the needle into the animal in a controlled manner. This controlled delivery of liquid eliminates the tissue damage associated with high flow and high pressure delivery by gas-powered pistons. In addition, the primary and secondary chambers of the basic van Rooyen dart are made of plastic, resulting in a dart which is lighter than earlier darts. Thus, impact-related tissue damage is reduced.

While the basic van Rooyen dart addresses many of the shortcomings of prior art injecting darts, it is perceived that it can be improved. In particular, the present invention is directed toward improving the barb and the venting design of the basic van Rooyen dart. Preferred embodiments of the dart of the present invention are considerably lighter than the van Rooyen dart, resulting in less impact-related tissue damage. And, one preferred embodiment has a needle which is integral with the hollow body, thus reducing manufacturing costs and increasing reliability.

With regard to the barb, the basic van Rooyen dart (shown in FIG. 1) has a barb which consists of a drop of silver solder 44 on the barrel of the needle. Not only does this involve an expensive and time-consuming process, it is perceived that there are potential problems associated with the difficulty of closely controlling the size, shape and bonding integrity of the solder drop 44. If the drop 44 is too small, the needle can fall out of the animal prior to delivery of the entire contents of the primary chamber. In fact, the delivery of the liquid alone could supply sufficient rearward pressure on the needle to cause it to fall out of the animal's hide if the barb 44 is insufficiently aggressive.

On the other hand, if the barb 44 on the basic van Rooyen dart is too pronounced the needle can remain in the animal for a period of time after the liquid has been injected. Further, if the drop 44 is too large it can effect the flight aerodynamics of the dart due to asymmetrical wind loading and due to the inherent imbalance created by the solder drop 44.

As in the case of prefabricated barbs, discussed above, the solder drop 44 could disconnect from the needle in which case the needle could prematurely fall out of the animal's hide and the solder drop 44 could remain within the animal. The solder drop 44 could fall off the needle at the time of firing; upon impact with the animal; or simply while the dart is being handled prior to firing.

Finally, the solder drop 44 could easily be longitudinally mislocated on the needle. The location and size of a barb 44 affect the dart's balance which in turn affects the flight of the dart. If the barb 44 is too large and too close to the needle's tip, the front end of the dart will be too heavy in comparison to the tail, and the dart will tend to prematurely dive during flight. Conversely, if the barb 44 is too small and too close to the root of the needle, the dart will tend to climb to a surprising degree.

The size and shape of the barb also directly affect the aerodynamics of the dart by virtue of the fact that the barb is mounted near the tip of the needle. For example, if the barb is excessively large, protruding laterally from the barrel of the needle, unnecessary drag will result and the dart's range will be decreased. It is perceived that the solder drop 44 of the basic van Rooyen dart causes an asymmetrical, erratic wind loading on the dart during flight.

The dart of the present invention includes a barb which is substantially symmetrical about the barrel of the needle. In addition, the barb's location, size and weight can be closely controlled. The barb of the present invention is an integral part of the needle itself, and the fabrication of the barb can easily be automated. Thus the location of the barb and its shape and size can be closely controlled.

It is also perceived that the vent design of the basic van Rooyen dart can be improved. If the secondary chamber is not adequately vented, the rate at which the liquid is injected into the animal can be adversely affected. Also, the vacuum in the secondary chamber caused by inadequate venting can prevent the piston from completing its stroke, thereby causing the dart to deliver only a portion of its contents.

The secondary chamber of the basic van Rooyen dart is vented by a single small hole 46 (referring to FIG. 1) drilled or molded through the wall of the secondary chamber. This single hole can easily be plugged during the manufacturing process, for example. Plugging is even more likely in the field, where a dart might be reused: while the needle is probably always cleaned between uses, the body of the dart is not treated with such care. The vent hole 46 of the basic van Rooyen dart is quite accessible, making its plugging more likely.

In addition to the plugging problems discussed above, the vent hole 46 of the basic van Rooyen dart is thought to be excessively small. The small vent hole 46 can limit the flow rate of air into the secondary chamber as the piston moves toward the primary chamber. The rate at which the piston moves and the resulting liquid flow rate can be adversely affected.

In preferred embodiments of the present invention, the single small vent hole 46 of the basic van Rooyen dart is replaced by two or more vent holes. Since it is unlikely that all of the vent holes will be simultaneously plugged, the dart of the present invention will almost assuredly deliver the entire contents of the primary chamber to the animal.

Preferred embodiments of injecting projectiles constructed according to the present invention are also considerably lighter than prior art projectiles, including the basic van Rooyen dart. As discussed above, lighter darts cause less tissue trauma to animals.

SUMMARY OF THE INVENTION

As discussed above, the invention is directed toward an injecting dart which includes improved vent and barb designs. One injecting dart according to the invention includes:

(a) a hollow body;

(b) a hollow needle in operative contact with the body;

(c) a piston having front and rear faces slidably constrained within the body, wherein a primary chamber suitable for containing the liquid is formed by the body and the front face of the piston and a secondary chamber is formed by the body and the rear face of the piston, and wherein the body forms a plurality of vent holes which vent the secondary chamber; and (d) resilient means in operative contact with the piston for urging the piston toward the primary chamber, wherein when the primary chamber is charged with the liquid and the needle enters the animal, the resilient means causes the piston to force the liquid through the needle into the animal, and the vent holes permit the free movement of the piston.

The body of the dart preferably includes forward and tail sections, wherein the vent holes are formed in the tail section.

Further, a preferred tail section includes a forward fin spanner, a rearward fin spanner, and a plurality of fins extending longitudinally from the forward fin spanner to the rearward fin spanner, wherein the vent holes are formed by the forward fin spanner between adjacent sets of fins.

Another injecting dart according to the present invention includes:

(a) a hollow body; and (b) a hollow needle having tip and base portions, wherein the base portion of the needle is in operative contact with the hollow body and wherein the needle forms an integral circumferential barb between its tip and base portions. The barb is preferably located substantially midway between the tip and base portions of the needle. For a stainless steel needle, the barb is preferably formed by controllably axially compressing the needle. For a plastic needle, the barb is preferably molded as an integral radial extension of the needle.

The barb preferably extends radially from the outside diameter of the barrel between approximately 0.155 and 0.180 inch, with the preferred extension being 0.168 inch.

Some preferred darts according to the invention also include needles which have curved tips to prevent plugging of the needle as it enters the animal. Alternatively, the needle forms transverse holes at its tip, whereby the interior of the needle is vented substantially perpendicular to the axis of the needle.

Preferred darts according to the present invention include multiple vent holes in their tail sections and an integral circumferential barb between the tip and the base portions of the needle of the dart.

Another dart embodiment according to the invention includes a needle which is integral with the forward section of the dart. Preferably, the forward section and the needle are of a single piece of plastic, e.g., acetal.

The tail section of darts according to the invention preferably includes a plurality of fins which extend only partially along the tail section so as to reduce its weight. Preferably, the fins are located toward the rearmost end of the tail section, thereby creating a relatively small diameter, relieved area between the fins and the forward section of the dart.

The holes which vent the secondary chamber to the atmosphere can be formed, in part, by a threaded joint between the forward and tail sections. The vent holes can also be formed, in part, by flats on a male threaded tail section and by diammetrically opposed slots in the tail section immediately adjacent the plane of abutment of the forward and tail sections.

BRIEF DESCRIPTION OF THE DRAWING

The invention is further explained with reference to the Drawing having the following figures:

FIG. 2 is a perspective view of one embodiment of a dart according to the present invention;

FIG. 3 is a longitudinal sectional view of the dart of FIG. 2, showing a charged primary chamber and a capped needle;

FIG. 4 shows another longitudinal view of the dart of FIG. 2, wherein the needle has penetrated the cap and an animal's hide and the liquid has been discharged from the primary chamber and through the needle into the animal;

DETAILED DESCRIPTION OF PREFERRED EMBODIMENTS

Figure 1:
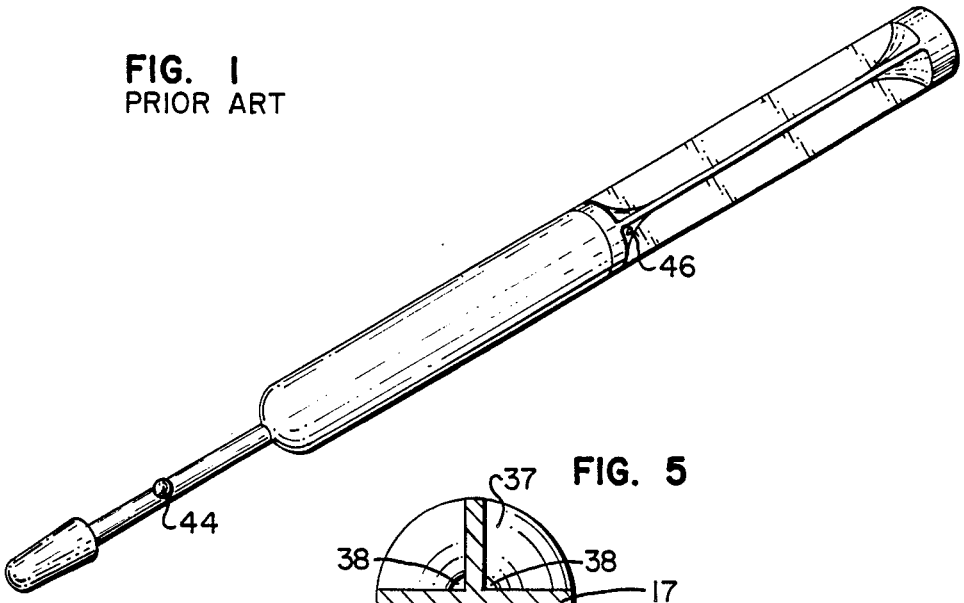
FIG. 1 PRIOR ART
FIG. 1 is a perspective view of a prior art dart.

Referring to the Drawing, wherein like reference numerals represent like parts and assemblies throughout the several views, FIG. 2 shows a perspective view of a dart 10 according to the present invention. The dart 10 includes three basic components: a needle 12, a forward section 14 and a tail section 16.

As shown in FIGS. 2 and 3, needle 12 includes a standard hollow stainless steel barrel 18 which has a root or base 11. Root 11 is flared so that it is well retained by the forward section 14. The barrel 18 is beveled roughly at a 45 degree angle at its forwardmost end to form a sharp tip 20. The tip 20 is bent inward slightly to form a protective hood over the core of the needle. The hood keeps the animal's hide from plugging the needle's core as the needle bores into the animal. This tip 20 is normally enclosed by resilient cap 22 as further described below.

The barrel 18 forms a ring-like barb 24 roughly at the midpoint of needle 12 between the root or base 11 and the tip 20. The barb 24 is preferably formed by longitudinally compressing the needle 12 in a controlled fashion. A two-piece jig or mold is preferably used to form the integral barb. The mold should generally be shaped to conform to the needle's barrel, but have a hollowed-out portion corresponding to the shape of the desired barb. Once the mold is closed, the ends of the needle are pushed toward each other with enough force and rapidity to cause the needle to bulge outward at the hollowed-out portion of the mold. The mold precisely controls the shape of the barb and its location relative to the tip and root of the needle. Such a technique is used to produce tubing joints, as well known to those skilled in the art.

The barrel of the needle preferably has an outside diameter of 0.120 inch and an inside diameter of 0.040 inch. The barb is preferably approximately 0.040 inch wide and extends radially or laterally between approximately 0.185 inch and 0.215 inch from the outside diameter of the barrel 18. Preferably, the barb extends radially approximately 0.200 inch from the barrel 18.

The needle 12 is connected to the forward section 14. The sections 14 and 16 of dart 10 are preferably injection molded plastic and are threaded together. While plastics such as cellulose-acetate-butyrate, polyester, polycarbonate, polypropylene and polyethylene could be used, the preferred material is a nylon. The forward section 14 contains the moving components which discharge the liquid through the needle 12 once it penetrates an animal's hide, whereas the tail section 16 is primarily included to counterbalance the forward section 14 and to provide flight stability.

As shown in FIG. 2, the core of the needle 12 is in fluid communication with a primary chamber 26 formed by the forward section 14. The needle 12 could be connected to the forward section 14 using a conventional adhesive or a press fit, or a combination of these techniques. Preferably, however, the forward section is injection molded around the flared root 11 of the needle 12 so as to securely connect the two parts together.

The rearmost end of the primary liquid chamber 26 is formed by a movable piston 28. The piston 28 is preferably made of a resilient material such as rubber. Styrenebutadiene, elastomer, thermoplastic rubber, or PVC could be used to form piston 28, with PVC being the preferred material. The resilient cap 22 is also preferably made of PVC or the like.

The forward face 30 of piston 28 is in contact with the primary chamber 26 while the frusto-conical rearward face 32 of piston 28 is in contact with a compression spring 34. Thus, employing the nomenclature established above, the spring 34 is contained within a secondary chamber 36*a* established partially by the piston 28. The secondary chamber 36*b* extends into the tail section 16.

The tail section 16 includes a forward fin spanner 15, a rearward fin spanner 19, and four equally-spaced fins 17 extending longitudinally from one spanner to the other. Of course, other fin configuations could be used. A male threaded portion on the forwardmost end of the tail section 16 threads into a female threaded rearmost end of the forward section 14. The secondary chamber 36*a* within the forward section 14 is in fluid communication with the secondary chamber 36*b* formed by the tail section 16. The secondary chambers 36 are axially aligned and are in fluid communication with each other.

Figure 5:
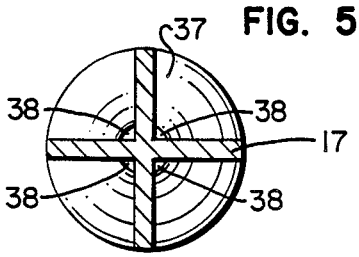
FIG. 5 is an enlarged view taken along line 5—5 of FIG. 2.
Figure 6:
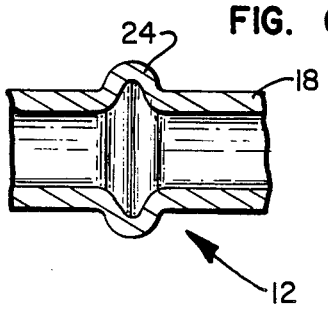
FIG. 6 is a an enlarged sectional veiw of the barb of the dart of FIG. 2.

The secondary chambers 36 are vented by four vent holes 38 in the tail section 16. FIG. 5 shows an enlarged axial view of the vent holes 38. Vent holes 38 are formed in the rearmost pointed areas of pie shaped regions 37 of the forward fin spanner 15 between the forwardmost portions of fins 17 of tail section 16. These vent holes 38 are preferably molded into the tail section 16, eliminating the need for drilling following the injection molding process. It should particularly be noted that there are preferably four vent holes formed between the four fins 17. Therefore, if one vent hole 38 should be partially or compeltely plugged, there would still be adequate venting of the secondary chambers 36 via the remaining vent holes 38.

The dart 10 can be fired by a wide variety of guns, including compressed gas (e.g., $CO_2$) or air guns and chemical explosion guns. For example, a standard Palmer gun could be used. The dart 10 is particularly useful for long distance injections due to its superior aerodynamic design. Use of the symmetrical barb 24 alone should improve the aerodynamics of the basic van Rooyen dart.

FIG. 4 illustrates dart 10 lodged in an animal's hide after the liquid has been injected. The tip 20 of needle 12 has pierced the cap 22 and the animal's hide and the needle 12 has lodged therein. Once the cap 22 has been pierced, the pressurized liquid within primary chamber 26 is forced into the animal by the action of the compressed spring 34 on the piston 28. The vent holes 38 in communication with the secondary chambers 36 allow complete and controlled emptying of the primary chamber 26. And, the barb 24 contains the needle 12 in the animal's hide for a period of time sufficient to allow complete emptying of the primary chamber 26.

Once the primary chamber 26 is empty, the needle 12 harmlessly disengages from the animal. The barb 24 has been designed to be sufficiently aggressive to hold the needle in the animal long enough to allow all of the liquid in the primary chamber 26 to flow trough the needle 12 into the animal. The barb 24 is not so aggressive that the needle 12 permanently lodges within the animal, however. The spent dart can thereafter be sterilized, refilled and reused. The dart 10 is filled by simply forcing liquid through the needle 12 into the primary chamber 26. As the primary chamber fills the piston 28 moves toward the secondary chambers 36 and compresses spring 34. Once the primay chamber is completely filled, the needle is capped. Alternatively, the piston is placed in a preselected position so as to establish, for example, a 2 cc primary chamber volume; the primary chamber is filled; the needle is capped; and a compressed spring is positioned behind the piston within the secondary chamber to pressurize the primary chamber. In either event, when the projectile strikes an animal, the needle penetrates the resilient cap and the animal's hide, and the pressurized liquid in the primary chamber flows through the needle into the animal in a controlled manner.

Figure 7:
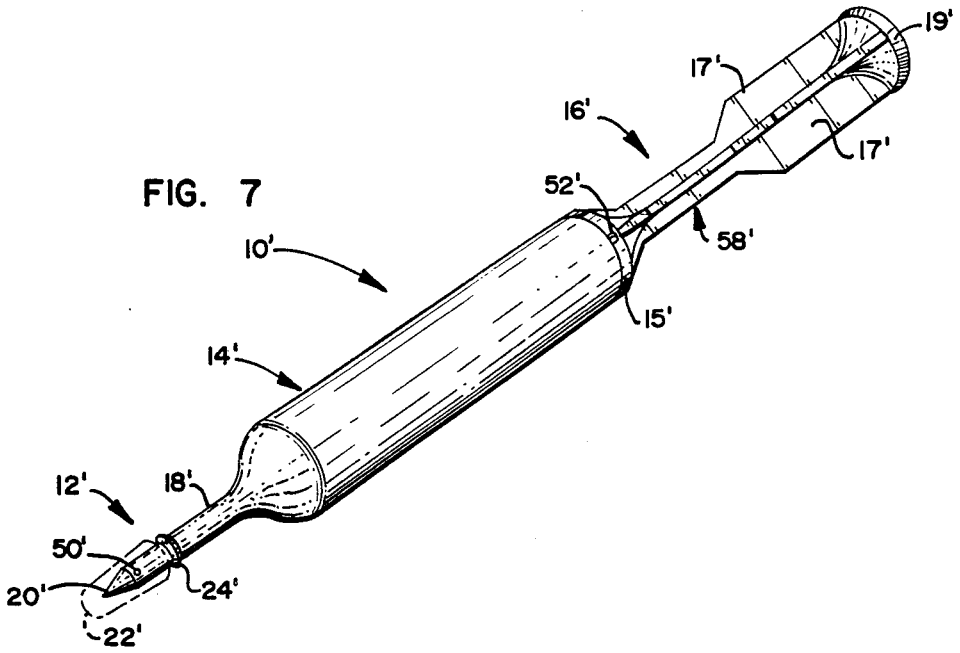
FIG. 7 is a perspective view of a second embodiment of the present invention.

FIG. 7 shows a perspective view of a dart 10' which represents a second embodiment of the present invention. As many of the components of dart 10' are at least functionally equivalent to those of dart 10, "primes" will be added to the reference numbers utilized above to designate like parts or assemblies in the second embodiment.

Dart 10' includes a forward section 14', a tail section 16', and a needle 12'. Unlike the two-piece needle/forward section assembly of dart 10, the needle 12' of dart 10' is integral with the forward section 14'. Needle 12' and forward section 14' are preferably formed from a single piece of molded plastic, e.g., Delrin Super Tough. Fabricating the needle 12' and hollow forward section 14' from a single piece of plastic makes the dart 10' even lighter than the dart 10, resulting in still greater range and accuracy.

The needle 12' and forward section 14' are preferably molded as a single piece using conventional injection molding, but other fabrication techniques are contemplated.

The needle 12' is also preferably shorter (0.800 inch versus 2.000 inch and thinner than needle 12. The needle 12' is made shorter primarily to reduce its weight. Shorter needles can be used for the relatively thin hides of most animals of interest found in the United States, e.g., elk and deer.

Like dart 10, dart 10' includes a circumferentail barb 24'. The barb 24' integrally formed by needle 12' is different from barb 24 of dart 10, however. It preferably circumscribes needle 12', but is triangular in cross section, each of its walls forming a 45 degree angle (or 135 degree angle) with the main barrel 18' of the needle 12'. Barb 24' can easily be designed to have this more aggressive design, as compared to barb 24, because it is molded, not cold formed as was the case for the barb 24 of metal needle 12.

The needle 12' is also different from needle 12 in that it has a straight tip 20' in contrast to the curved tip 20. Plugging of tip 20' is prevented through the use of a pair of transverse holes 50' in the tip 20'. The axes of the transverse holes 50' are substantially perpendicular to the longitudinal axis of the needle 12', so that when the needle 12' penetrates the animal's hide the hide is not forced into the holes 50' so as to plug them.

Figure 8:
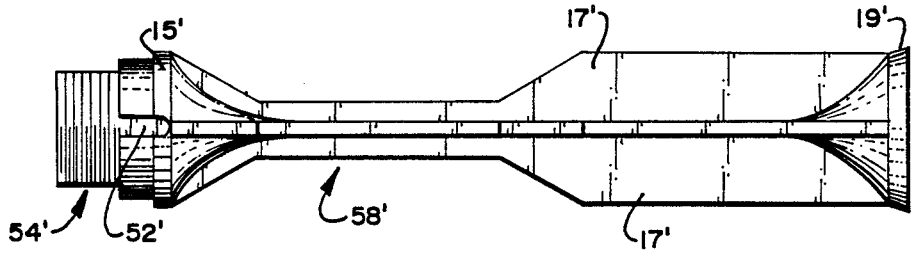
FIG. 8 is a side elevational view of the tail section of the dart of FIG. 7.
Figure 9:
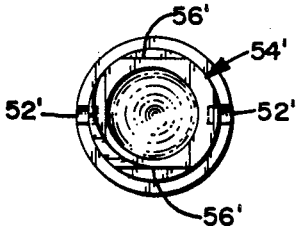
FIG. 9 is an end view of the tail section of the dart of FIG. 7.

Turning to the tail section 16', as shown in FIGS. 8 and 9, the venting scheme employed in dart 10' is different from that used in dart 10. Tail section 16' forms a pair of slots 52' at the plane where the forward fin spanner 15' abutts the rearmost portion of the forward section 14' when the sections 14' and 16' are threaded together. Slots 52' are preferably 0.100 inch wide and 0.060 inch deep and are in fluid communication with male threaded portion 54' formed by the tail section 16'. The threaded section 54' forms a pair of diametrically apposed flats 56' which extend the length of the threaded section 54'. The slots 52'; threads 54'; and flats 56' are in fluid communication and serve to vent the secondary chamber formed in part by the tail section 16' and in part by the forward section 14'. Thus, slots 52' and attendant parts are functionally analogous to the holes 38 of dart 10, but can be more easily molded along with the tail section 16' in one step.

Tail section 16' also differs from tail section 16 in that the fins 17' are relieved to reduce the weight of dart 10'. Approximately half of each fin 17' is removed toward the forward spanner 15' of tail section 16', leaving only a central stem 58' connecting the forward fin spanner 15' and the rear finned portion.

The internal components (piston and spring) of dart 10' are preferably identical to those of dart 10.

Thus, the weight of dart 10' is reduced primarily through the use of a shorter, integral, plastic needle 12' and relieved fins 17'. When a nylon or acetal material is used to make darts 10 and 10', the unfilled weight of dart 10' is 8.95 grams compared to a weight of 11.94 grams for a 2 cc van Rooyen dart shown in FIG. 1. And, a standard 2 cc Palmer dart, such as the one disclosed in U.S. Pat. No. 3,209,696, weighs approxnimately 15 grams. Launched by the same propulsive power, the Palmer dart droops 6.5 feet over a 100 foot flight whereas dart 10' droops only a few inches, if that. It is through that this increased accuracy is atributable primarily to the reduce weight of dart 10' and its improved aerodynamics.

It should be emphasized that the present invention is not limited to any particular components, materials or configurations, and modifications of the invention will be apparent to those skilled in the art in light of the foregoing description. This description is intended to provide specific examples of individual embodiments which clearly disclose the present invention. Accordingly, the invention is not limited to these embodiments or to the use of elements having the specific configurations and shapes as presented herein. All alternative modifications and variations of the present invention which fall within the spirit and broad scope of the appended claims are included.

I claim:

1. A dart for injecting a liquid into an animal, comprising:

(a) a hollow body comprising a forward section and a tail section in threaded connection thereto, the body including a plurality of longitudinal fins;

(b) a hollow needle in operative contact with the forward section of the body, wherein the needle forms an barb thereon, the barb being hollow, circumferential, and annular in shape, the barb being of one piece construction with the needle;

(c) a piston having front and rear faces slidably constrained within the body, wherein a primary chamber suitable for containing the liquid is formed by a portion of the forward section and the front face of the piston, and a secondary chamber is formed by a portion of the forward section, a portion of the tail section and the rear face of the piston, and wherein the body forms a plurality of vent holes in its tail section which vent the secondary chamber; and (d) resilient means in operative contact with the piston for urging the piston toward the primary chamber, wherein the primary chamber is charged with the liquid and the needle enters the animal, the resilient means causes the piston to force the liquid through the needle into the animal, and the vent holes permit the free movement of the piston.

2. The dart of claim 1, wherein the tail section comprises a forward fin spanner, a rearward fin spanner and a plurality of fins extending longitudinally from the forward fin spanner to the rearward fin spanner, wherein the vent holes are formed by the forward fin spanner between adjacent sets of fins.

3. The dart of claim 1, wherein the tail section comprises four fins and forms four vent holes.

4. The dart of claim 1, wherein the needle has tip and base portions, wherein the base portion of the needle is in operative contact with the hollow body, and wherein the needle tip is curved so as to prevent plugging of the needle as it enters the animal.

5. The injection dart of claim 1, wherein the needle has a tip and base portion and the barb is substantially midway between the tip and base portions.

6. The injecting dart of claim 5, wherein the barb is of one piece construction with the needle, whereby the one piece construction is accomplished by controllably axially compressing the needle.

7. The injecting dart of claim 6, wherein the barb extends radially from the outside diameter of the barrel of the needle between approximately 0.155 and 0.180 inch.

8. The injecting dart of claim 1, wherein the barb extends radially from the outside diameter of the barrel of the needle by 0.168 inch.

9. The injecting dart of claim 1, wherein the ratio of the diameter of the barb to the outside diameter of the needle is about 2.

10. The injecting dart of claim 1, wherein the needle has an inside diameter of about 0.040 inch and about a 0.040 inch wall thickness.

11. The dart of claim 1, wherein the vent holes are formed proximate the threaded joint.

12. The dart of claim 11, wherein the tail section comprises a male threaded portion and the forward section comprises a female threaded portion and wherein the male threaded portion comprises a pair of flats which form, in part, the vent holes.

13. The dart of claim 1, wherein the needle has tip and base portions, the base portion of the needle being integrally connected to the forward section of the hollow body whereby the connection is accomplished by injection molding the forward section around the base portion.

14. The dart of claim 13, wherein the needle and forward section are of a single piece of plastic.

15. The dart of claim 1, wherein the tail section comprises a forward fin spanner and rearward fin spanner and a plurality of fins extending longitudinally from the forward fin spanner to the rearward fin spanner.

16. The dart of claim 15, wherein the fins are relieved, extending only along a portion of the tail section, whereby the weight of the dart is reduced.

17. The dart of claim 16, wherein the fins extend approximately one-half the length of the tail section and are located proximate the rearmost end of the tail section.

18. A dart for injecting a liquid into an animal, comprising:

(a) a hollow body comprising a forward section and a tail section operatively connected thereto, wherein the tail section comprises a forward fin spanner, a rearward fin spanner and four equally spaced fins extending longitudinally from the forward fin spanner to the rearward fin spanner;

(b) a hollow needle having tip and base portions, wherein:

(i) the base portion of the needle is in operative contact with the forward section of the body;

(ii) the needle forms a barb between its tip and base portions, the barb being hollow, circumferential, and annular in shape, the barb being of one piece construction with the needle; and (iii) the needle tip is curved so as to prevent plugging of the needle as it enters the animal;

(c) a piston having front and rear faces slidably constrained within the forward section of the body, wherein a primary chamber suitable for containing the liquid is formed by the body and the front face of the piston and a secondary chamber is formed by the body and the rear face of the piston, and wherein four vent holes are formed by the forward fin spanner between adjacent sets of fins;

(d) a cap suitable for covering the tip of the needle to retain the liquid in the primary chamber; and (e) a spring housed within the secondary chamber in operative contact with the face of the piston for moving the piston toward and into the primary chamber wherein when the primary chamber is charged with liquid and the dart strikes the animal the needle penetrates the cap and the spring causes the piston to force the liquid through the needle into the animal, and the vent holes permit free movement of the piston.

19. A dart for injecting a liquid into an animal, comprising:

(a) a hollow body suitable for containing the liquid comprising a forward section and a tail section;

(b) a hollow needle integral with the forward section of the body, wherein the needle and forward section of the body are molded from a single piece of plastic, the needle including a barb which is of one piece construction with the needle, the barb being hollow, circumferential, and annular in shape; and (c) means responsive to impact of the dart with the animal contained within the hollow body for forcing the liquid out of the hollow body and through the needle into the animal.

20. The dart of claim 19, wherein the needle and forward section are molded from Delrin plastic.

21. A dart for injecting a liquid into an animal, comprising:

(a) a hollow body comprising a forward section and a tail section in threaded connection thereto, wherein the tail section comprises a plurality of fins extending a portion of the way from the front end of the tail section to the rear end of the tail section;

(b) a hollow needle integral with the forward section of the body, wherein the needle and forward section of the body are molded from a single piece of plastic, said needle including a barb which is of one piece construction with the needle, the barb being hollow, circumferential, and annular in shape;

(c) a piston having front and rear faces slidably constrained within the body, wherein a primary chamber suitable for containing the liquid is formed by the body and the front face of the piston and a secondary chamber is formed by the body and the rear face of the piston, and wherein a plurality of vent holes are formed proximate the threaded joint between the forward and tail sections suitable for venting the secondary chamber; and (d) resilient means in operative contact with the piston for urging the piston toward the primary chamber, wherein when the primary chamber is charged with the liquid and the needle enters the animal, the resilient means causes the piston to force the liquid through the needle into the animal, and the vent holes permit the free movement of the piston.

* * * * *

UNITED STATES PATENT AND TRADEMARK OFFICE

CERTIFICATE OF CORRECTION

PATENT NO. : 4,735,612

DATED : April 5, 1988

INVENTOR(S) : Martin A. Chevalier

It is certified that error appears in the above-identified patent and that said Letters Patent is hereby corrected as shown below:

In column 2, line 64, after "sphere" and before "The" please add --.--

In column 7, line 58, please delete "compeltely" and substitute --completely--.

In column 8, line 17, please delete "trough" and substitute --through--.

In column 8, line 25, please delete "primay" and substitute --primary--.

In column 8, line 64, please delete "circumferentail" and substitute --circumferential--.

In column 9, line 18, please delete "abutts" and substitute --abuts--.

In column 9, line 24, please delete "apposed" and substitute --opposed--.

In column 9, lines 48-49, please delete "approxnimately" and substitute --approximately--.

In column 9, line 52, please delete "through" and substitute --thought--.

UNITED STATES PATENT AND TRADEMARK OFFICE

CERTIFICATE OF CORRECTION

PATENT NO. : 4,735,612

DATED : April 5, 1988

INVENTOR(S) : Martin A. Chevalier

It is certified that error appears in the above-identified patent and that said Letters Patent is hereby corrected as shown below:

In column 9, line 52, please delete "atributable" and substitute --attributable--.

In column 9, line 53, please delete "reduce" and substitute --reduced--.

In column 10, line 8, please delete "an" and substitute --a--.

In column 10, line 47, please delete "6" and substitute --1--.

Signed and Sealed this

Twenty-first Day of March, 1989

*Attest:*

*Attesting Officer*

DONALD J. QUIGG

*Commissioner of Patents and Trademarks*